US010166451B1

(12) United States Patent
Laskowitz

(10) Patent No.: US 10,166,451 B1
(45) Date of Patent: Jan. 1, 2019

(54) RING TOSS GAME

(71) Applicant: Randolph G. Laskowitz, Bourbon, MO (US)

(72) Inventor: Randolph G. Laskowitz, Bourbon, MO (US)

( * ) Notice: Subject to any disclaimer, the term of this patent is extended or adjusted under 35 U.S.C. 154(b) by 0 days.

(21) Appl. No.: 15/680,857

(22) Filed: Aug. 18, 2017

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 67/06
USPC ..... 273/336
See application file for complete search history.

(56) References Cited

U.S. PATENT DOCUMENTS 411,221 A * 9/1889 Stazzone ..... A63B 67/06 273/338
611,915 A * 10/1898 Klauder ..... A63F 9/02 273/337
626,328 A * 6/1899 Olsen ..... A63B 67/06 273/338
976,492 A * 11/1910 Prickett ..... A63F 3/00 273/141 R
1,052,907 A * 2/1913 Fergusson ..... A63F 9/02 273/332
1,230,503 A 6/1917 Miller
1,553,665 A * 9/1925 Bergsten ..... E21B 19/06 294/90
2,942,886 A * 6/1960 Ackerman ..... A63B 67/10 273/332
3,009,702 A * 11/1961 Lyon ..... A63F 9/30 273/332
3,520,535 A * 7/1970 McGlade ..... A63B 67/10 273/332
3,815,915 A * 6/1974 Chapman ..... A63F 9/0208 273/338
4,120,499 A * 10/1978 Stazzone ..... A63B 67/06 273/338
4,180,266 A 12/1979 Morin et al.
4,635,942 A * 1/1987 Flaherty, Jr. ..... A63B 67/10 273/332
4,898,392 A 2/1990 Goletz
4,982,966 A * 1/1991 Teafatiller ..... A63B 67/06 273/336
4,984,797 A * 1/1991 Norsworthy ..... A63F 9/0406 273/145 C
5,171,019 A * 12/1992 Arnette ..... A63B 67/10 273/332

(Continued)

*Primary Examiner* — John E Simms, Jr.
*Assistant Examiner* — Dolores Collins
(74) *Attorney, Agent, or Firm* — Cramer Patent & Design, PLLC; Aaron R. Cramer

(57) ABSTRACT

A ring toss game includes a scoreboard, a play area, and a plurality of rings. The score board includes a vertical pole having scoring tabs on opposites of the pole. A clothes pin is provided for each side of the scoreboard and may be used to selectively clamp onto a given tab thereby displaying a given score. The play area includes a first square tray perpendicularly secured to a second square tray along a common side. In the center of the first square tray is a perpendicular object tube about which rings may be tossed in a game of skill. In the center of the second tray on the same side as that of the object tube is a hook. The hook is positioned to hold rings when not in use.

10 Claims, 4 Drawing Sheets

(56) References Cited

U.S. PATENT DOCUMENTS

| | | | | |
|---|---|---|---|---|
| 5,340,113 | A * | 8/1994 | Respicio | A63F 3/00006 273/138.1 |
| 5,873,573 | A * | 2/1999 | Beatty, Jr. | A63B 67/06 273/336 |
| 6,755,711 | B2 * | 6/2004 | McClung | A63B 67/00 273/398 |
| 7,494,418 | B2 * | 2/2009 | Rifkin | G07F 17/32 463/46 |
| 7,500,674 | B2 * | 3/2009 | Riley | A63B 67/06 273/126 R |
| 2004/0108652 | A1 * | 6/2004 | Vaden | A63B 67/06 273/126 R |
| 2008/0116644 | A1 | 5/2008 | Knoernschild | |
| 2010/0176554 | A1 * | 7/2010 | Godwin | A63B 67/06 273/338 |
| 2010/0181726 | A1 | 7/2010 | Bos | |
| 2013/0062830 | A1 | 3/2013 | Brunner | |
| 2014/0001705 | A1 | 1/2014 | Goebel | |

* cited by examiner

RING TOSS GAME

RELATED APPLICATIONS

Not applicable.

FIELD OF THE INVENTION

The present invention relates generally to lawn games and, more particularly, to a ring toss game that includes a game board housed in a portable target box.

BACKGROUND OF THE INVENTION

Outdoor activities, commonly referred to as lawn games, such as horseshoes, ring toss, cornhole, lawn darts, croquet, and the like, can be found in backyards and tailgates across the country. Such activities are among the most popular of today's recreational and social activities. Not only are they a great entertainment value, they also serve to bring families and friends closer together for conversation and interaction that is just not possible when watching television, reading a book, surfing the Internet, or playing an electronic game. However, most backyard games are quickly figured out by even the youngest of players, and one quickly becomes bored.

Accordingly, game manufacturers are constantly on the lookout for the next backyard game that will sweep the nation and become a common pastime activity and there exists a need for a new and exciting backyard games.

SUMMARY OF THE INVENTION

The inventor has recognized the aforementioned, inherent problems and lack in the art and observed that there is a need for a new, portable lawn game. The development of the present invention, which will be described in greater detail herein, fulfills this need.

In an embodiment, the disclosed ring toss game includes a target box including a game board having a first game surface positioned in an approximately vertical orientation and a second game surface positioned in an approximately horizontal orientation; a ring hook connected to the game board and extending from the first game surface; and a ring post connected to the game board and extending from the second game surface. The ring toss game also includes a ring. When the ring is tossed at the game board, the ring hangs on the ring hook, encircles the ring post, or lands on the second game surface.

In another embodiment, the disclosed ring toss game includes a plurality of target boxes. Each of the plurality of target boxes includes a base section including a second game surface of a game board positioned in an approximately horizontal orientation; a box section connected to the base section and including a side wall extending along a perimeter of the base section and forming a barrier around the second game surface; a lid section connected to the box section and including a first game surface of the game board positioned in an approximately vertical orientation; a ring hook connected to the lid section and extending from the first game surface; and a ring post connected to the base section and extending from the second game surface. The ring toss game also includes a plurality of rings. When a ring of the plurality of rings is tossed at the game board of a target box of the plurality of target boxes, the ring hangs on the ring hook, encircles the ring post, or lands on the second game surface.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWINGS

The advantages and features of the embodiments and examples disclosed herein will become better understood with reference to the following more detailed description and claims taken in conjunction with the accompanying drawings, in which like elements are identified with like symbols, and in which:

DESCRIPTIVE KEY

Figure 1:
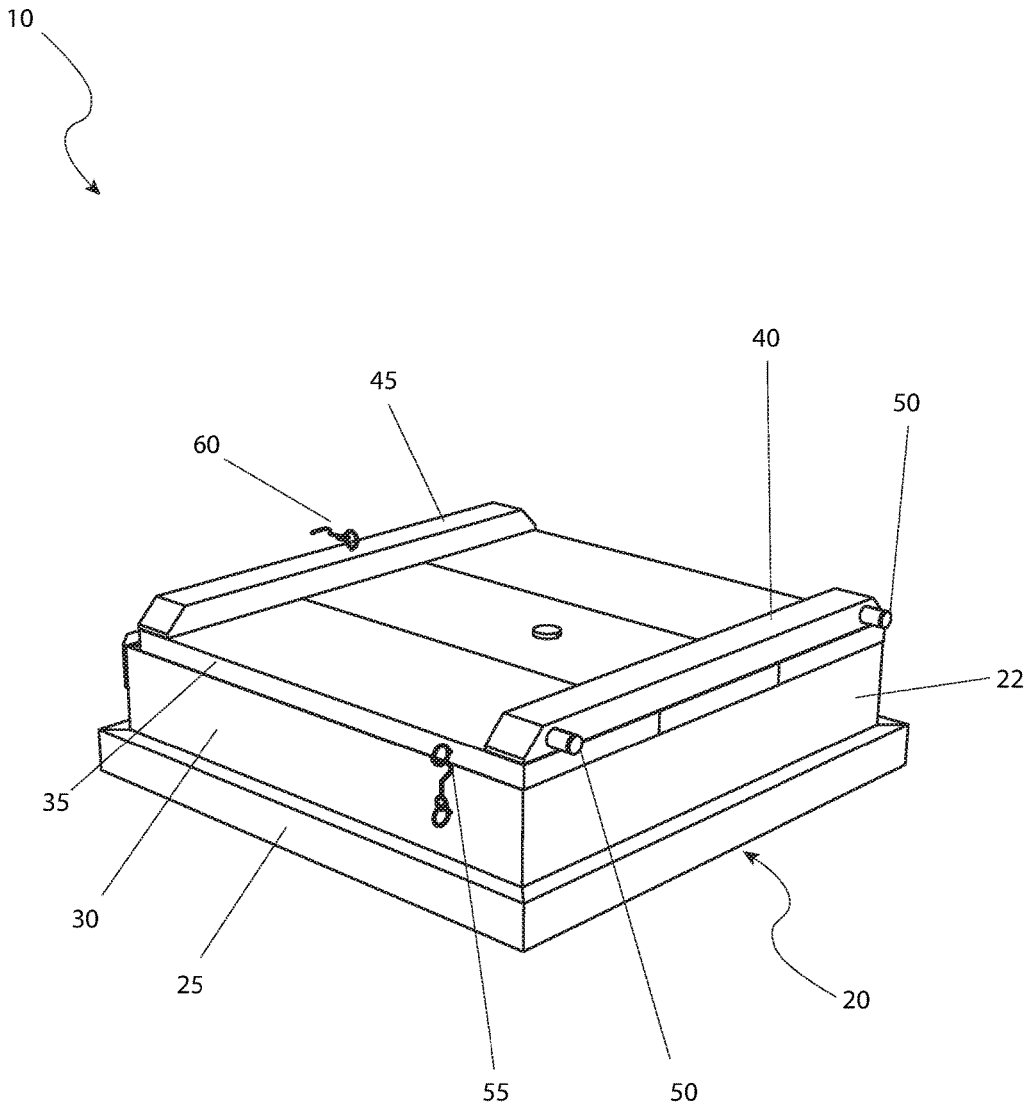
FIG. 1 is a front and side perspective view of an embodiment of the disclosed ring toss game, depicted in a closed state.

10 ring toss game
15 ring
20 target box
22 game board
24 first game surface
25 base section
26 second game surface
30 box section
32 side wall
35 lid section
40 first stiffening member
45 second stiffening member
50 feet
55 closed clasp hook
60 open clasp hook
65 box interior space
70 lower support brace
75 handle
80 hook nut
85 ring hook
86 shank portion
88 arcuate portion
90 target area marking
95 ring post
96 shaft portion
98 head portion
100 first target box
105 second target box
110 distance "d"
115 Player One
120 Player Two

DETAILED DESCRIPTION OF THE PREFERRED EMBODIMENT

In accordance with the invention, the best mode is presented in terms of example embodiments, herein depicted within FIGS. 1-4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one (1) particular configuration may be shown and described for purposes of clarity and disclosure and not by way of limitation of scope.

The terms "a" and "an" herein do not denote a limitation of quantity, but rather denote the presence of at least one (1) of the referenced items.

Referring to FIGS. 1-4, disclosed is a ring toss game (herein generally referred to herein as the "game") 10, where like reference numerals represent similar or like parts. The disclosed game 10 generally includes a scoreboard, a play area, and a plurality of rings. The score board includes a vertical pole having scoring tabs on opposites of the pole. A clothes pin is provided for each side of the scoreboard and may be used to selectively clamp onto a given tab thereby displaying a given score. The play area includes a first square tray perpendicularly secured to a second square tray along a common side. In the center of the first square tray is a perpendicular object tube about which rings may be tossed in a game of skill. In the center of the second tray on the same side as that of the object tube is a hook. The hook is positioned to hold rings when not in use.

Figure 4:
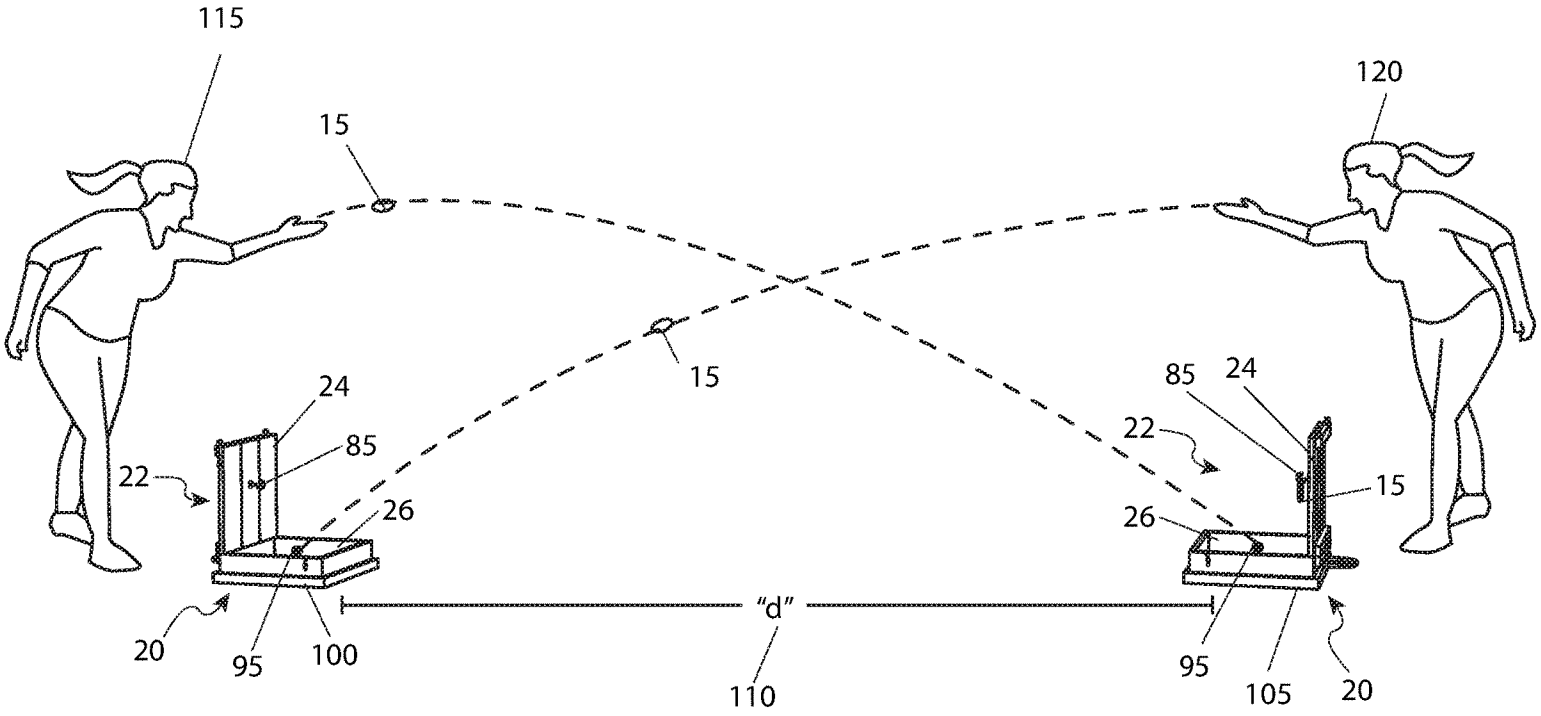

Referring to FIG. 4, a schematic environmental view of an embodiment of the disclosed game, depicted in a utilized state, is disclosed. In an example, the game 10 including a series of rings 15 and a pair of target boxes 20 (identified herein as a first target box 100 and a second target box 105).

Referring to FIG. 1, a front and side perspective view of an example target box 20 of an embodiment of the game 10, depicted in a closed state, is disclosed. Each of the target boxes 20 (only a single target box 20 is illustrated by example in FIG. 1) are envisioned to be manufactured from wood or a suitable equivalent material with similar weight and durability properties. In an example, the target box 20 includes three (3) main sections; a base section 25, a box section 30, and a lid section 35.

In an example, the box section 30 is approximately eighteen inches square (18 in2.) and three inches (3 in.) high. The base section 25 is approximately twenty inches square (20 in2.) and three quarters of an inch (¾ in.) high. The lid section 35 is approximately the same size as the box section 30, and is and three quarters of an inch (¾ in.) high.

In an example, the lid section 35 includes a first stiffening member 40 and a second stiffening member 45 configured to assist the lid section 35 in maintaining a flat profile over time.

In an example, the first stiffening member 40 includes two (2) feet 50 at its outermost edges. The feet 50 are designed to offset the distance difference between the base section 25 and the box section 30, thus allowing the target box 20 to stand upright for the purposes of transportation and/or storage. During the stored state, a series of two (2) closed clasp hooks 55 are provided (only one (1) closed clasp hook 55 is visible in FIG. 1). The closed clasp hooks 55 is shown in an engaged state in FIG. 1 as the target boxes 20 is shown in a closed state. An open clasp hook 60 is also provided on the second stiffening member 45 to hold the lid section 35 open. The open clasp hook 60 is shown disengaged in FIG. 1 as the target box 20 is shown in a closed state.

Figure 2:
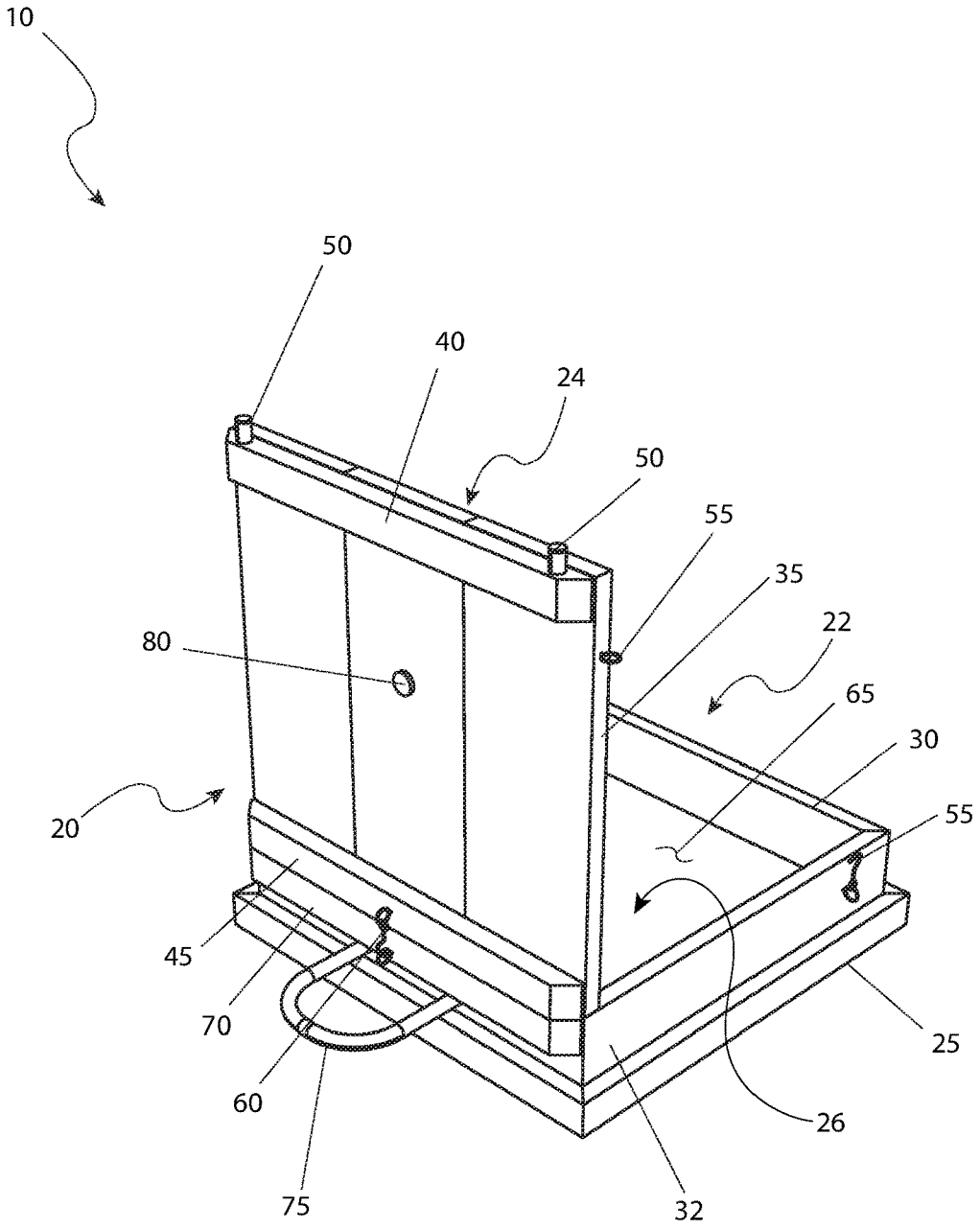
FIG. 2 is a rear and side perspective view of the disclosed ring toss game, depicted in an open state.

Referring to FIG. 2, a rear and side perspective view of the example target box 20 of an embodiment of the game 10, depicted in an open state, is disclosed. FIG. 2 depicts the open, or deployed, state of the target box 20, with the lid section 35 positioned at a ninety-degree angle (90°) to the box section 30 and base section 25. Such positioning produces a box interior space 65, which will be described in greater detail herein below. It should be noted that the closed clasp hook 55 is shown in a disengaged state, while the open clasp hook 60 is shown in an engaged state due to the open state profile as presented in FIG. 2.

In an example, a matching component of the open clasp hooks 60 is mounted on a lower support brace 70 that is affixed to the box section 30. The second stiffening member 45 and the lower support brace 70 also serve as a mounting location for a hinge (not visible in FIG. 2).

In an example, a rope handle 75 is affixed to the lower edge of the lower support brace 70 to aid in the transport of the target box 20 while in its closed state (FIG. 1).

In an example, a hook nut 80 is located on a surface of the lid section 35 in an approximate center location. The hook nut 80 is used to secure a ring hook 85 (not shown in FIG. 2) on the opposite side of the lid section 35 and will be described in greater detail herein below.

Figure 3:
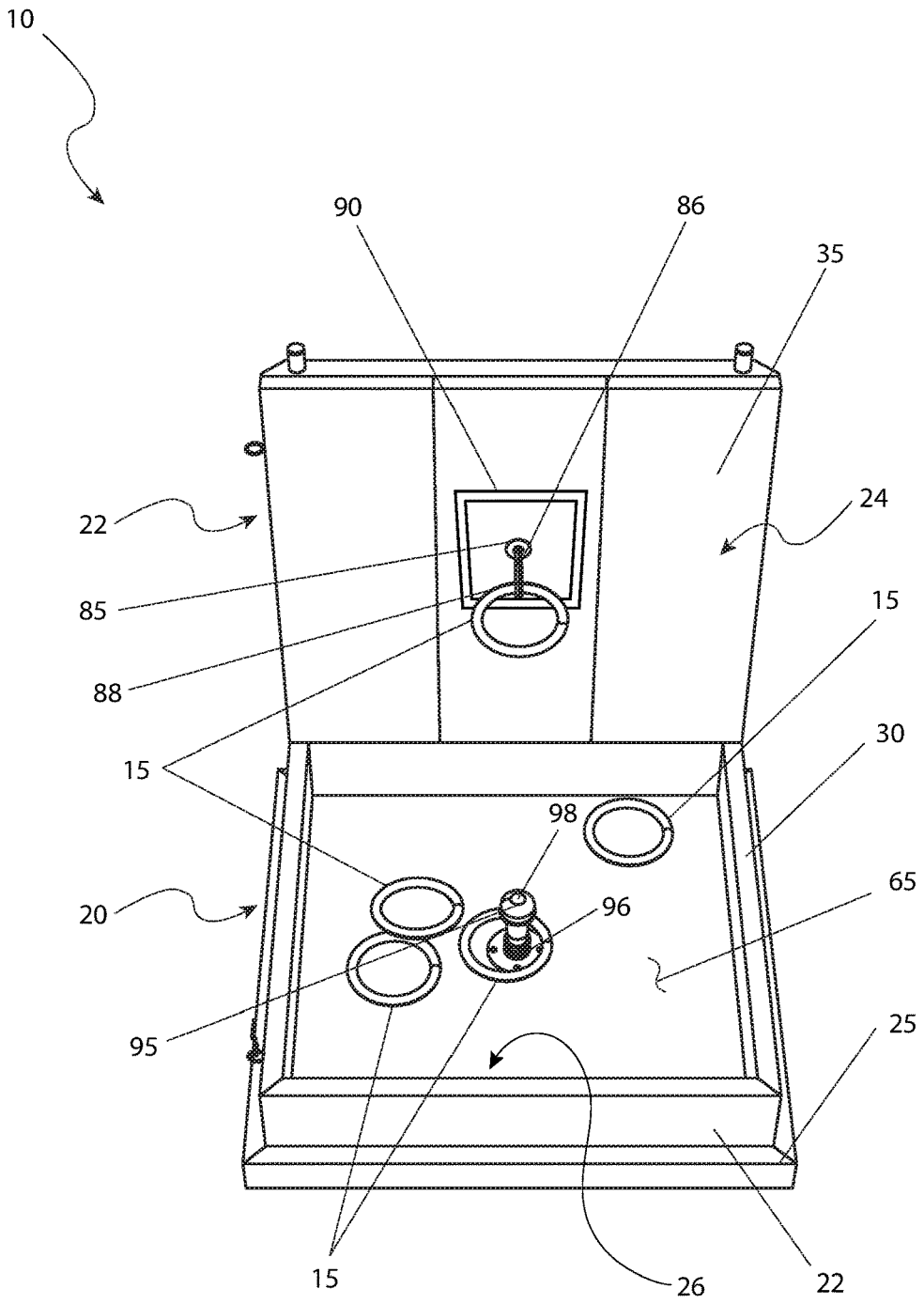
FIG. 3 is a front perspective view of an embodiment of the disclosed ring toss game, depicted in a deployed, or "in-use," state; and, FIG. 4 is a schematic environmental view of an embodiment of the disclosed ring toss game, depicted being utilized by players.

Referring to FIG. 3, a front perspective view of an example of the target box 20 of an embodiment of the game 10, depicted in a deployed, or "in-use," state, is disclosed. The ring hook 85 is visible in the center of the lid section 35 and is surrounded by a brightly colored target area marking 90. The ring hook 85 serves as a desired target area for the rings 15, one (1) of which is shown hanging from the ring hook 85.

In an example, the rings 15 are envisioned to be manufactured of steel, and would be approximately two and a half inches (2½ in.) in diameter. Other diameters of the rings 15 are also contemplated.

In an example, the ring hook 85 is viewed to take the form of a large cup hook, commonly known in the art. As an example, the ring hook 85 has a length of between approximately one and one-quarter inches (1¼ in.) and two and a half inches (2½ in.) and a diameter of approximately three-eighths of an inch (⅜ in.). Other dimensions for the ring hook 85 are also contemplated.

In an example, the box interior space 65 is provided with a center ring post 95 located in a central location. The center ring post 95 is envisioned to be approximately two and a half inches long (2½ in.) and three-eighths of an inch (⅜ in.) in diameter. Other dimensions for the ring post 95 are also contemplated. The center post 95 serves as a desired target area for the rings 15, one (1) of which is shown around the center post 95. Placement of the rings 15 on the ring hook 85, the center post 95 or in the box interior space 65 serve as a method of scoring and will be described in greater detail herein below.

Referring to FIG. 4, a schematic environmental view of an embodiment of the game 10, depicted in a utilized state, is disclosed. In an example, the first box 100 is separated from the second box 105 by a distance "d" 110. As an example, the distance "d" 110 is envisioned to be approximately twenty to twenty-five feet (20-25 ft.). However, other distance "d" 110 can also be utilized, both shorter and longer, depending on player skill level, and as such, the use of any particular distance "d" 110 should not be interpreted as a limiting factor. FIG. 4 depicts single player teams, consisting of a Player (or Team) One 115 and a Player (or Team) Two 120. However, the number of players (e.g., on a team) may vary from one (1), two (2), three (3), or four (4) or more players. Similarly, the number of teams may vary. Similarly, the number of target boxes 20 may vary. In the illustrative example, Player One 115 and Player Two 120 each have their own respective target box 20. However, in another embodiment of the disclosed game 10, both player, or teams, may utilize the same target box 20. An example of the disclosed method of play and scoring will be described herein below.

Referring to FIGS. 1-4, in an embodiment, the disclosed game 10 includes the target box 20. The target box 20 includes a game board 22 having a first game surface 24 positioned in an approximately vertical orientation and a second game surface 26 positioned in an approximately horizontal orientation. The target box 20 also includes the ring hook 85 connected to the game board 22 and extending from the first game surface 24. The target box 20 also includes the ring post 95 connected to the game board 22 and extending from the second game surface 26. The game 10 also includes the ring 15. When the ring 15 is tossed at the game board 22, the ring 15 one of hangs on the ring hook 85, encircles the ring post 95, or lands on the second game surface 26.

In another embodiment of the disclosed game 10, the target box includes the base section 25, the box section 30 connected to the base section 25, and the lid section 35 pivotally connected to the box section 30. A surface of the base section 25 forms the second game surface 26. A surface of the lid section 35 forms the first game surface 24. The box section 30 includes a side wall 32 that extends along a perimeter of the base section 25 and forms a barrier around the second game surface 26.

In another embodiment of the disclosed game 10, the first game surface 24 includes a target marking area 90 surrounding the ring hook 85.

In another embodiment of the disclosed game 10, the lid section 35 is configured to pivot relative to the box section 30 between an open position, in which the lid section 35 is approximately perpendicular to the base section 30 exposing the first game surface 24 and the second game surface 26, and a closed position, in which the lid section 35 is approximately parallel with the base section 25 enclosing the box section 30. The target box 20 also includes the closed clasp loop 55 connected to the box section 30. With the lid section 35 in the closed position, the closed clasp loop 55 is configured to be releasably connected to the lid section 35 to secure the lid section 35 in the closed position. The target box 20 also includes the open clasp loop 60 connected to the box section 30. With the lid section 35 in the open position, the open clasp loop 60 is configured to be releasably connected to the lid section 35 to secure the lid section 35 in the open position.

In another embodiment of the disclosed game 10, the target box 20 also includes the handle 75 connected to the box section 30. The target box 20 also includes at least one stiffening member 40, 45 connected to the lid section 35 opposite to the first game surface 24. The target box 20 also includes the plurality of feet 50 extending from the lid section 35. With the target box 20 oriented in an approximately vertical orientation, the target box 20 is supported on the base section 25 and the plurality of feet 50.

Referring still to FIGS. 1-4, in an embodiment, the disclosed game 10 includes a plurality of target boxes 20 (e.g., the first target box 100 and the second target box 105) (FIG. 4). Each target box 20 includes a base section 25 that includes the second game surface 26 of the game board 22 positioned in an approximately horizontal orientation. Each target box 20 also includes the box section 30 connected to the base section 25 and that includes the side wall 32 extending along a perimeter of the base section 25 and forming a barrier around the second game surface 26. Each target box 20 also includes the lid section 35 connected to the box section 30 and that includes the first game surface 24 of the game board 22 positioned in an approximately vertical orientation. Each target box 20 also includes the ring hook 85 connected to the lid section 35 and extending from the first game surface 24. Each target box 20 also includes the ring post 95 connected to the base section 25 and extending from the second game surface 26. The game 10 also includes a plurality of the rings 15. When a ring 15 of the plurality of rings 15 is tossed at the game board 22 of one target box 20 of the plurality of target boxes 20, the ring 15 one of hangs on the ring hook 85, encircles the ring post 95, or lands on the second game surface 26.

In another embodiment of the disclosed game 10, the first game surface 24 includes the target are marking 90 surrounding the ring hook 85.

In another embodiment of the disclosed game 10, the lid section 35 is pivotally connected to the box section 30 and is configured to pivot relative to the box section 30 between an open position, in which the lid section 35 is approximately perpendicular to the base section 25 exposing the first game surface 24 and the second game surface 26, and a closed position, in which the lid section 35 is approximately parallel with the base section 25 enclosing the box section 30. Each target box 20 also includes the closed clasp loop 55 connected to the box section 30. When the lid section 35 is in the closed position, the closed clasp loop 55 is configured to be releasably connected to the lid section 35 to secure the lid section 35 in the closed position. Each target box 20 also includes the open clasp loop 60 connected to the box section 30. When the lid section 35 is in the open position, the open clasp loop 60 is configured to be releasably connected to the lid section 35 to secure the lid section 35 in the open position.

In another embodiment of the disclosed game 10, each target box 20 also includes the handle 75 connected to the box section 30. Each target box 20 also includes the plurality of stiffening members 40, 45 connected to the lid section 35 opposite to the first game surface 24. Each target box 20 also includes the plurality of feet 50 connected to one of the plurality of stiffening members 40 and extending from the lid section 35. With the target box 20 oriented in an approximately vertical orientation, the target box 20 is supported on the base section 25 and the plurality of feet 50.

In another embodiment of the disclosed game 10, the ring hook 85 is connected to the lid section 35 at an approximate center of the first game surface 24. The ring hook 85 includes a shank portion 86 connected to the lid section 35 and extending perpendicular to the first game surface 24. The ring hook 85 also includes an arcuate portion 88 extending from the shank portion 86. The arcuate portion 88 has a sweep of approximately one-hundred and eighty degrees (180°).

In another embodiment of the disclosed game 10, the ring post 95 is connected to the base section 25 at an approximate center of the second game surface 26. The ring post 95 includes a shaft portion 96 connected the base section 25 and extending perpendicular to the second game surface 26. The ring post 95 also includes a head portion 98 extending from the shaft portion 96. The head portion 98 has a cross-sectional dimension larger than a cross-sectional dimension of the shaft portion 96.

Examples of the disclosed game 10 can be utilized by the common user in a simple and effortless manner with little or no training. It is envisioned that the game 10 would be constructed in general accordance with FIGS. 1-4. After initial purchase or acquisition of the apparatus 10, it would be configured and utilized as indicated in FIGS. 1-4. In an example implementation, as illustrated in FIG. 4, the game 10 includes two (2) target boxes 20 (e.g., the first box 100 and the second box 105) and eight (8) rings 15.

To setup the ring toss game 10 for play, the first box 100 and the second box 105 are transported to the game playing area, either inside or outside, and separated for the desired first box 100. They are both set upon their base section 25. Next, the two (2) closed clasp hooks 55 are disengaged and the lid section 35 opened to a ninety degree (90°) position with respect to the box section 30. This position is secured via engagement of the open clasp hooks 60. The rings 15 are distributed with four (4) rings to each group of players. At this point in time, play may begin.

A game begins by Player One 115 (or Team One) throwing their four (4) rings 15 at the second box 105. A ring 15 within the box interior space 65 counts as one (1) point. A ring 15 on the center post 95 counts as three (3) points and cancels all other rings in the second box 105. A ring 15 on the ring hook 85 counts as five (5) points. Points are tallied. Play then transfers to the Player Two 120 (or Team Two) who then throws their rings 15 with scoring taking place in the same manner. If at the conclusion of one (1) round of play, no points are scored upon the center post 95 or the ring hook 85, the Team or Player with the most rings 15 in the box interior space 65 gets one (1) point. If neither Team nor Player has any rings within the box interior space 65 no points are awarded. Rings 15 are then retrieved and another round of play commences.

Various rounds continue in an alternating pattern as described above until one (1) Player or Team reaches eleven (11) or twenty-one (21) points, for either a short game or longer game as previously agreed to. The winning Player or Team must have at least two (2) points difference with the losing Player or Team. If not, play continues until one (1) Player or Team is ahead by two (2) points at the end of a round.

It is envisioned that other rules or alternate rules may be utilized as well as agreed to by the players or teams, and as such, the use of any prescribed rules, including those aforementioned described, are not intended to be a limiting factor of the present invention.

At the conclusion of game play, the ring(s) 15 would be stored in one (1) of the target boxes 20, the open clasp hooks 60 disengaged, the lid section 35 closed, and the closed clasp hooks 55 engaged. The target boxes 20 are then carried by the rope handle 75 to a suitable storage space until needed again.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

The invention claimed is:

1. A game, comprising:

a target box, comprising:

a game board, comprising:

a first game surface positioned in a vertical orientation;

a second game surface positioned in a horizontal orientation to said first game surface when opened;

wherein said first game surface comprises a lid section and a target marking area surrounding said ring hook;

wherein said second game surface comprises a base section having a box section comprising a side wall extending along a perimeter of said base section and forming a barrier around said second game surface;

wherein said box section is pivotally connected to said lid section;

wherein said base section defines said second game surface;

a ring hook connected to said game board and extending from said first game surface, and said ring hook comprises a shank portion connected to said lid section and extending perpendicular to said first game surface, and an arcuate portion extending from said shank portion; wherein said arcuate portion has a sweep of one-hundred and eighty degrees, said ring post is connected to said base section at said center of said second game surface; and said ring post comprises a shaft portion connected said base section and extending perpendicular to said second game surface, and a head portion extending from said shaft portion, wherein said head portion has a cross-sectional dimension larger than a cross-sectional dimension of said shaft portion;

a ring post connected to said game board and extending from said second game surface; and a ring;

wherein, when said ring is tossed at said game board, said ring hangs on said ring hook, encircles said ring post, or lands on said second game surface; and wherein said lid section pivots relative to said box section between an open position, in which said lid section is perpendicular to said base section exposing said first game surface and said second game surface, and a closed position, in which said lid section is parallel with said base section enclosing said box section and securing said first game surface and said second game surface within said game.

2. The game of claim 1, wherein:

said target box further comprises a closed clasp loop connected to said box section;

when said lid section is in said closed position, said closed clasp loop is releasably connected to said lid section to secure said lid section in said closed position.

3. The game of claim 1, wherein:

said target box further comprises an open clasp loop connected to said box section; and when said lid section is in said open position, said open clasp loop is releasably connected to said lid section to secure said lid section in said open position.

4. The game of claim 1, wherein said target box further comprises a handle connected to said box section.

5. The game of claim 1, wherein said target box further comprises at least one stiffening member connected to said lid section opposite to said first game surface.

6. The game of claim 1, wherein:

said target box further comprises a plurality of feet extending from said lid section, said feet are designed to offset a distance between the base section and the box section; and with said target box oriented in a vertical orientation, said target box is supported on said base section and said feet.

7. A game comprising:

a plurality of target boxes, each of said plurality of target boxes having a game board, comprising:

a first game surface positioned in an approximately vertical orientation; and, a second game surface positioned in an approximately horizontal orientation to said first game surface when opened;

wherein said first game surface comprises a lid;

wherein said second game surface comprises a base section having a box section comprising a side wall extending along a perimeter of said base section and forming a barrier around said second game surface;

wherein said box section is pivotally connected to said lid; and, wherein said base section defines said second game surface;

a ring hook connected to said lid section and extending from said first game surface, said ring hook connected to said lid section at a center of said first game surface, and said ring hook comprises a shank portion connected to said lid section and extending perpendicular to said first game surface, and an arcuate portion extending from said shank portion; wherein said arcuate portion has a sweep of one-hundred and eighty degrees, said ring post is connected to said base section at said center of said second game surface; and said ring post comprises a shaft portion connected said base section and extending perpendicular to said second game surface, and a head portion extending from said shaft portion, wherein said head portion has a cross-sectional dimension larger than a cross-sectional dimension of said shaft portion; and a ring post connected to said base section and extending from said second game surface; and, a plurality of rings;

wherein, when a ring of said plurality of rings is tossed at said game board of a target box of said plurality of target boxes, said ring one of hangs on said ring hook, encircles said ring post, or lands on said second game surface; and, wherein said lid section is configured to pivot relative to said box section between an open position, in which said lid section is approximately perpendicular to said base section exposing said first game surface and said second game surface, and a closed position, in which said lid section is approximately parallel with said base section enclosing said box section and securing said first game surface and said second game surface within said game.

8. The game of claim 7, wherein:

said target box further comprises a closed clasp loop connected to said box section; and when said lid section is in said closed position, said closed clasp loop is releasably connected to said lid section to secure said lid section in said closed position.

9. The game of claim 7, wherein:

said target box further comprises an open clasp loop connected to said box section; and, when said lid section is in said open position, said open clasp loop is releasably connected to said lid section to secure said lid section in said open position.

10. The game of claim 7, wherein said target box further comprises:

a handle connected to said box section;

a plurality of stiffening members connected to said lid section opposite to said first game surface; and a plurality of feet connected to one of said plurality of stiffening members and extending from said lid section, said feet are designed to offset a distance between the base section and the box section, wherein with said target box oriented in a vertical orientation, said target box is supported on said base section and said feet.

* * * * *